US007007662B2

(12) United States Patent
Sakai et al.

(10) Patent No.: US 7,007,662 B2
(45) Date of Patent: Mar. 7, 2006

(54) FUEL SUPPLY APPARATUS FOR INTERNAL COMBUSTION ENGINE

(75) Inventors: Mitsuto Sakai, Toyota (JP); Daichi Yamazaki, Toyota (JP); Tatsuhiko Akita, Toyota (JP); Naoki Kurata, Aichi-ken (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/050,773

(22) Filed: Feb. 7, 2005

(65) Prior Publication Data

US 2005/0193982 A1 Sep. 8, 2005

(30) Foreign Application Priority Data

Mar. 2, 2004 (JP) ..... 2004-057942

(51) Int. Cl.
*F02M 37/04* (2006.01)

(52) U.S. Cl. ..... 123/299; 123/512

(58) Field of Classification Search ..... 123/299, 123/300, 512, 511
See application file for complete search history.

(56) References Cited

U.S. PATENT DOCUMENTS 6,786,201 B1 * 9/2004 Ohtani ..... 123/299
2003/0168037 A1 * 9/2003 zur Loye et al. ..... 123/299
2003/0221661 A1 * 12/2003 Willi et al. ..... 123/299

FOREIGN PATENT DOCUMENTS

JP A 7-103048 4/1995

* cited by examiner

*Primary Examiner*—Erick Solis
(74) *Attorney, Agent, or Firm*—Oliff & Berridge, PLC

(57) ABSTRACT

An ECU calculates the difference between the fuel pressure in a high-pressure distribution pipe and a target pressure when fuel is injected only from an air-intake passage injector. The ECU determines the bulk modulus of fuel that is associated with the coolant temperature. The ECU determines the amount of fuel that is to be discharged from a high-pressure pump based on the pressure difference and the bulk modulus. Then, the ECU actuates the high-pressure pump in accordance with the determined discharge amount.

19 Claims, 4 Drawing Sheets

FUEL SUPPLY APPARATUS FOR INTERNAL COMBUSTION ENGINE

CROSS-REFERENCE TO RELATED APPLICATIONS

This application is based upon and claims the benefit of priority from prior Japanese Patent Application No. 2004-057942, filed on Mar. 2, 2004, the entire contents of which are incorporated herein by reference.

BACKGROUND OF THE INVENTION

The present invention relates to a fuel supply apparatus for an internal combustion engine that pressurizes fuel with a high-pressure pump and discharges the fuel from the pump into a high-pressure pipe for supplying high-pressure fuel to an in-cylinder injector.

Japanese Laid-Open Patent Publication No. 7-103048 discloses a conventional fuel supply apparatus for an internal combustion engine. The conventional fuel supply apparatus is applied to an internal combustion engine that includes an in-cylinder injector and an air-intake passage injector in each of its cylinders. The internal combustion engine normally activates an appropriate one of the above two types of injectors to inject fuel according to the engine driving state, such as the engine load and the engine speed. When fuel is to be injected from the in-cylinder injector (in-cylinder injection mode), high-pressure fuel needs to be supplied to a high-pressure distribution pipe connected to the in-cylinder injector.

In the in-cylinder injection mode, a high-pressure pump pressurizes fuel to raise the pressure of the fuel in the high-pressure distribution pipe to a predetermined pressure. When fuel is to be injected from the air-intake passage injector (port injection mode), the high-pressure pump stops operating to lower the fuel pressure in the high-pressure distribution pipe. However, the conventional fuel supply apparatus cannot instantaneously raise the fuel pressure to the predetermined pressure when switching from the port injection mode to the in-cylinder injection mode. Further, when switching from the port injection mode to the in-cylinder injection mode, large pulsations of the fuel pressure occurs in the high-pressure distribution pipe. This causes the injection amount of fuel to be unstable, and degrades the combustion characteristics of the internal combustion engine. To solve this problem, the fuel pressure in the high-pressure distribution pipe may be raised by actuating the high-pressure pump in the port injection mode when the fuel pressure in the high-pressure distribution pipe becomes lower than a lower limit pressure. This would keep the fuel pressure in the high-pressure distribution pipe greater than or equal to the lower limit pressure even in the port injection mode.

However, the entire amount of low-pressure fuel in the high-pressure pump would be discharged into the high-pressure distribution pipe every time the fuel pressure in the high-pressure distribution pipe becomes lower than the lower limit pressure. Thus, the high-pressure pump may excessively raise the fuel pressure in the high-pressure distribution pipe. An excessively high fuel pressure may cause fuel to leak from the in-cylinder injector or may deteriorate exhaust emission from the internal combustion engine.

SUMMARY OF THE INVENTION

It is an object of the present invention to provide a fuel supply apparatus for an internal combustion engine having an in-cylinder injector and an air-intake passage injector that adjusts and stabilizes the pressure of high-pressure fuel when the engine is driven to inject fuel only from the air-intake passage injector.

One aspect of the present invention is a fuel supply apparatus for an internal combustion engine. The internal combustion engine includes a combustion chamber, an air intake passage connected to the combustion chamber, an in-cylinder injector for directly injecting fuel into the combustion chamber, an air-intake passage injector for injecting fuel into the air intake passage, a low-pressure pump for pumping fuel from a fuel tank and discharging low-pressure fuel, a low-pressure pipe for supplying the low-pressure fuel to the air-intake passage injector, a high-pressure pump for pressurizing the low-pressure fuel and discharging high-pressure fuel, and a high-pressure pipe for supplying the high-pressure fuel to the in-cylinder injector. The fuel supply apparatus includes a controller for controlling the high-pressure pump. If the pressure of the fuel in the high-pressure pipe is lower than a target pressure by a predetermined value when the fuel is being injected only from the air-intake passage injector, the controller determines a discharge amount for the high-pressure pump that is necessary to raise the pressure of fuel in the high-pressure pipe to the target pressure. Further, the controller controls the high-pressure pump in accordance with the determined necessary discharge amount.

Another aspect of the present invention is a supply apparatus for an internal combustion engine. The internal combustion engine includes a combustion chamber, an air intake passage connected to the combustion chamber, an in-cylinder injector for directly injecting fuel into the combustion chamber, an air-intake passage injector for injecting fuel into the air intake passage, a low-pressure pump for pumping fuel from a fuel tank and discharging low-pressure fuel, a low-pressure pipe for supplying the low-pressure fuel to the air-intake passage injector, a high-pressure pump for pressurizing the low-pressure fuel and discharging high-pressure fuel, and a high-pressure pipe for supplying the high-pressure fuel to the in-cylinder injector. The fuel supply apparatus includes a pressure sensor for detecting the pressure of the fuel in the high-pressure pipe and generating a detection signal according to the pressure. A controller controls the high-pressure pump in accordance with the detection signal. If the pressure of the fuel in the high-pressure pipe is lower than a tolerable range when the fuel is being injected only from the air-intake passage injector, the controller determines a discharge amount for the high-pressure pump that is necessary for the high-pressure pump to achieve the tolerable range. Further, the controller generates a drive signal for driving the high-pressure pump in accordance with the determined necessary discharge amount.

A further aspect of the present invention is a fuel supply apparatus for an internal combustion engine. The internal combustion engine includes a combustion chamber, an air intake passage connected to the combustion chamber, an in-cylinder injector for directly injecting fuel into the combustion chamber, an air-intake passage injector for injecting fuel into the air intake passage, a low-pressure pump for pumping fuel from a fuel tank and discharging low-pressure fuel, a low-pressure pipe for supplying the low-pressure fuel to the air-intake passage injector, a high-pressure pump for pressurizing the low-pressure fuel and discharging high-pressure fuel, and a high-pressure pipe for supplying the high-pressure fuel to the in-cylinder injector. The fuel supply apparatus includes a pressure sensor for detecting the pressure of the fuel in the high-pressure pipe and generating a detection signal according to the pressure. A controller controls the high-pressure pump in accordance with the detection signal. The controller is programmed to determine a discharge amount for the high-pressure pump that is necessary for the high-pressure pump to achieve the tolerable range if the pressure of the fuel in the high-pressure pipe is lower than a tolerable range during a period in which the in-cylinder injector stops injecting fuel, and to generate a drive signal for driving the high-pressure pump in accordance with the determined necessary discharge amount.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A fuel supply apparatus for an internal combustion engine according to a preferred embodiment of the present invention will now be described with reference to FIGS. 1 to 4. In the preferred embodiment, the internal combustion engine is a four-cylinder gasoline engine.

Figure 1:
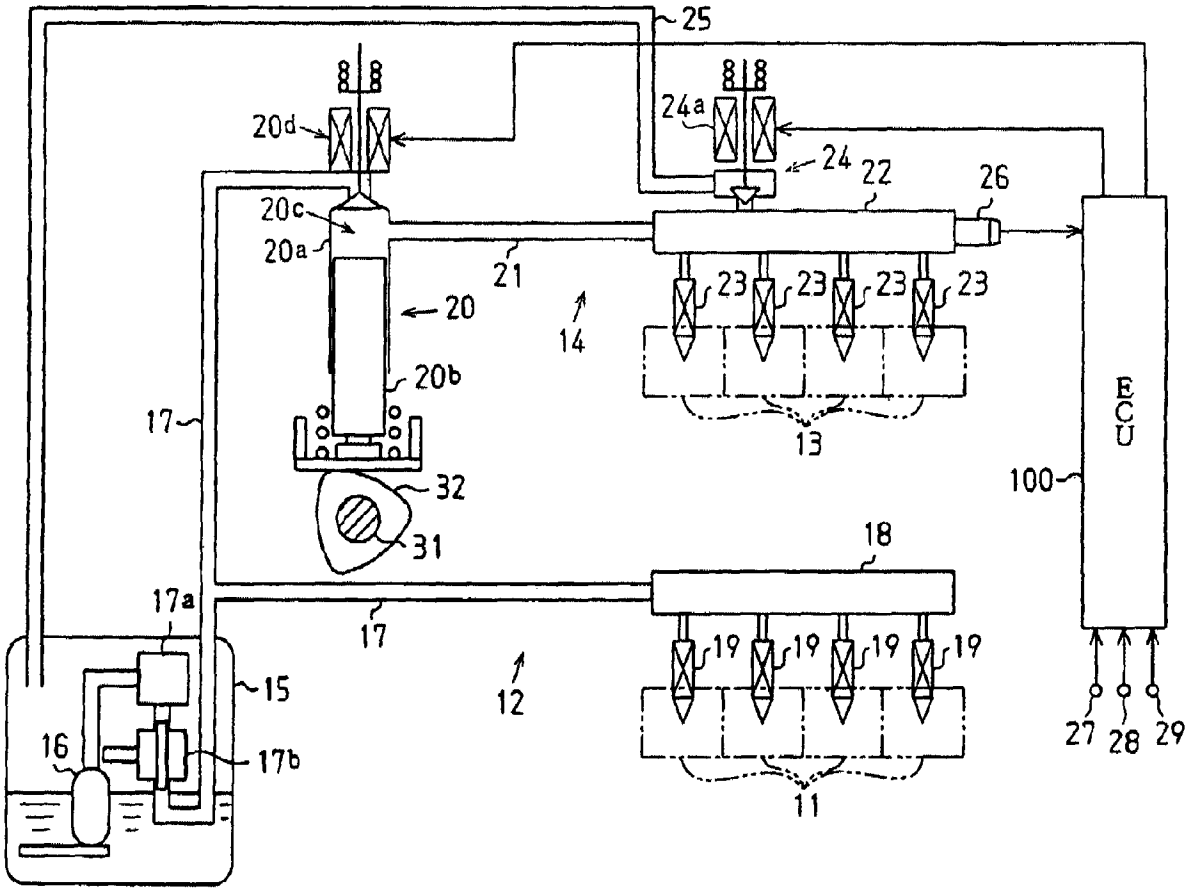
FIG. 1 is a schematic diagram of a fuel supply apparatus for an internal combustion engine according to a preferred embodiment of the present invention.

As shown in FIG. 1, the fuel circulation system for the internal combustion engine includes a low-pressure fuel system 12 for injecting fuel into intake ports 11 of an air-intake passage and a high-pressure fuel system 14 for directly injecting fuel into combustion chambers 13.

The low-pressure fuel system 12 includes a fuel tank 15 containing fuel, and a feed pump 16 (low-pressure pump) for pumping fuel. Fuel pumped by the feed pump 16 is sent to a low-pressure distribution pipe 18 (low-pressure pipe) via a filter 17*a* and a pressure regulator 17*b*, which are arranged in a low-pressure fuel passage 17. The filter 17*a* filters the fuel. The pressure regulator 17*b* adjusts the pressure of the fuel in the low-pressure fuel passage 17. In the preferred embodiment, the pressure regulator 17*b* returns the fuel in the low-pressure fuel passage 17 to the fuel tank 15 when the fuel pressure in the low-pressure fuel passage 17 is greater than or equal to a predetermined pressure (e.g., 0.4 MPa) so that the fuel pressure in the low-pressure fuel passage 17 is maintained below the predetermined pressure. The low-pressure distribution pipe 18 distributes low-pressure fuel to an air-intake passage injector 19 arranged in each cylinder of the internal combustion engine. Each air-intake passage injector 19 injects fuel into its corresponding intake port 11.

The high-pressure fuel system 14 includes a high-pressure pump 20, which is connected to the low-pressure fuel passage 17. The high-pressure pump 20 has a cylinder 20*a*. A plunger 20*b* is accommodated in the cylinder 20*a*. The plunger 20*b* is in contact with a cam 32, which is arranged on an intake camshaft 31. The plunger 20*b* reciprocates in the cylinder 20*a* following the rotation of the cam 32. An inner surface of the cylinder 20*a* and an upper end surface of the plunger 20*b* define a pressurizing chamber 20*c*. Low-pressure fuel is drawn into the pressurizing chamber 20*c* from the low-pressure fuel passage 17 and pressurized by the plunger 20*b*. Then, the relatively high pressure fuel is discharged from the high-pressure pump 20 to the high-pressure fuel passage 21 and sent to a high-pressure distribution pipe 22 (high-pressure pipe). In this manner, the pressure of the fuel in the high-pressure distribution pipe 22 is raised.

The high-pressure distribution pipe 22 distributes high-pressure fuel to an in-cylinder injector 23 arranged in each cylinder of the internal combustion engine. Each in-cylinder injector 23 injects fuel directly into its corresponding combustion chamber 13. An electromagnetic spill valve 20*d* is arranged in the high-pressure pump 20. The amount of low-pressure fuel drawn into the pressurizing chamber 20*c* from the low-pressure fuel passage 17 is varied by adjusting the open time of the electromagnetic spill valve 20*d*. In this manner, the amount of fuel supplied from the high-pressure pump 20 to the high-pressure distribution pipe 22 is adjusted.

A relief valve 24 is arranged in a drain passage 25 connecting the high-pressure distribution pipe 22 and the fuel tank 15. In the preferred embodiment, the relief valve 24 is an electromagnetic valve that opens in response to voltage applied to an electromagnetic solenoid 24*a*. When the relief valve 24 is open, high-pressure fuel in the high-pressure distribution pipe 22 is returned to the fuel tank 15 via the drain passage 25. This lowers the pressure of fuel in the high-pressure distribution pipe 22 to adjust the fuel pressure to an appropriate pressure.

Appropriate ones of the air-intake passage injectors 19 and the in-cylinder injectors 23 are used in accordance with the engine load or the engine speed of the internal combustion engine.

For example, when fuel is injected from the in-cylinder injectors 23 (in-cylinder injection mode), fuel directly injected into the combustion chambers 13 is expected to cool the combustion chambers 13. In the in-cylinder injection mode, atomized fuel must be injected into the combustion chambers 13. During high-load driving, in which a large amount of intake air is drawn into the combustion chambers 13 and the atomization of fuel is enhanced, the internal combustion engine is set in the in-cylinder injection mode. During low-load driving, a small amount of intake air is drawn into the combustion chambers 13. Thus, enhancement of fuel atomization in the combustion chambers 13 cannot be expected. In this case, the internal combustion engine is set in a port injection mode in which fuel is injected only from the air-intake passage injectors 19. In the in-cylinder injection mode, the fuel pressure in the high-pressure distribution pipe 22 must be kept high.

The fuel supply apparatus includes an electronic control unit (ECU) 100 for controlling the operations of the high-pressure pump 20 and the relief valve 24. The ECU 100 controls the entire internal combustion engine according to the engine driving state. The ECU 100, for examples, selects the injectors 19 and 23 and adjusts the amount of fuel injected from the injectors 19 and 23.

The ECU 100 is connected to a pressure sensor 26, which monitors the fuel pressure in the high-pressure distribution pipe 22. The ECU 100 is provided with a detection signal from the pressure sensor 26. An accelerator sensor 27, which is attached to an accelerator pedal, provides the ECU 100 with a detection signal having a voltage proportional to the depressed amount of the accelerator pedal. A rotation speed sensor 28, which is arranged, for example, in the vicinity of a crankshaft, provides the ECU 100 with a detection signal that is in accordance with the rotation speed of the crankshaft. A temperature sensor 29, which is attached to a cylinder block of the internal combustion engine, provides the ECU 100 with a detection signal that is in accordance with the temperature of coolant circulated in a water jacket.

The ECU 100 determines or calculates the engine load and the engine speed, based on the detection signals provided from these sensors, and determines the driving state of the internal combustion engine from the calculated engine load and the calculated engine speed. The ECU 100 actively controls actuation of the high-pressure pump 20 in the in-cylinder injection mode.

When the engine is driven to inject fuel only from the air-intake passage injectors 19 (port injection), the ECU 100 executes control to stabilize the fuel pressure in the high-pressure distribution pipe 22. Specifically, when the fuel pressure in the high-pressure distribution pipe 22 is lower than a target pressure by a predetermined value or more, the ECU 100 determines or calculates the discharge amount of the high-pressure pump 20 necessary to raise the fuel pressure in the high-pressure distribution pipe 22 to the target pressure. The ECU 100 actuates the high-pressure pump 20 so as to achieve the calculated discharge amount. For example, the ECU 100 generates a drive signal for actuating the high-pressure pump 20 to discharge the calculated amount and provides the high-pressure pump 20 with the drive signal. In the preferred embodiment, the drive signal is a signal having a duty corresponding to the open time of the electromagnetic spill valve 20*d*.

Figure 2:
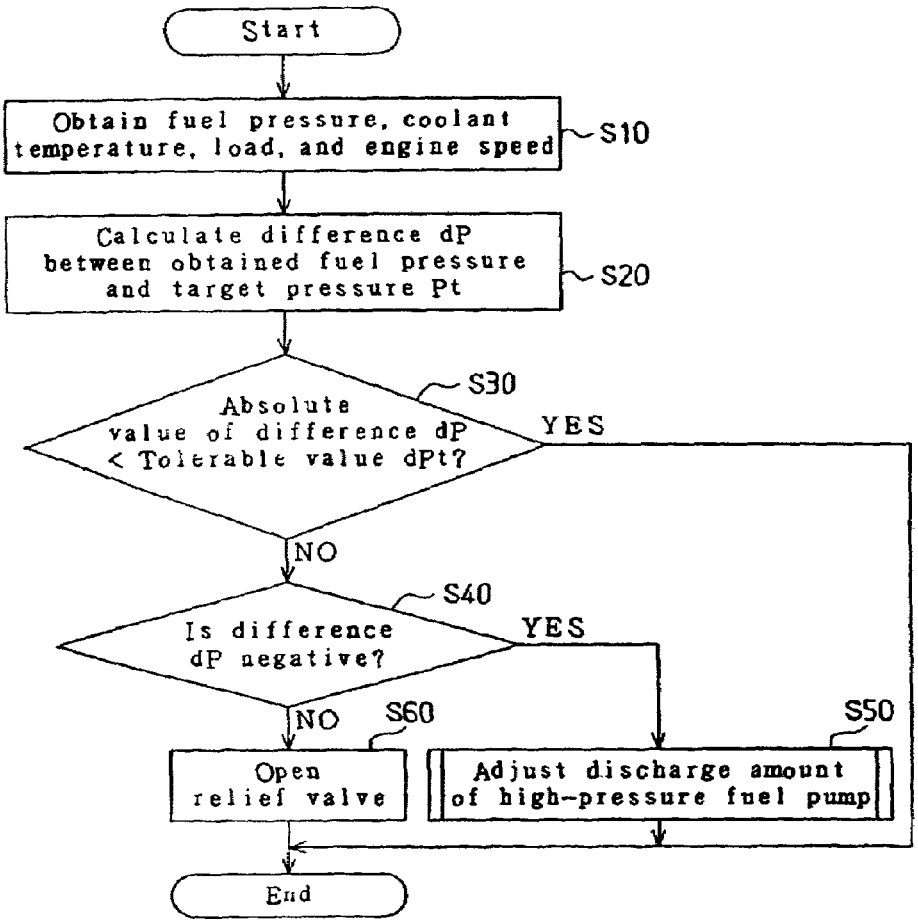
FIG. 2 is a flowchart showing control of fuel pressure in a high-pressure distribution pipe that is executed during a port injection mode.

FIG. 2 is a flowchart showing control (adjustment) of the fuel pressure in the high-pressure distribution pipe 22 that is executed during the port injection mode. The ECU 100 repeatedly executes the control in predetermined time intervals. The ECU 100 functions as a control unit.

In step S10, the ECU 100 calculates the fuel pressure in the high-pressure distribution pipe 22 and the coolant temperature from the detection signals of the pressure sensor 26 and the temperature sensor 29, respectively. The ECU 100 calculates the engine load and the engine speed from the detection signals of the accelerator sensor 27 and the rotation speed sensor 28, respectively.

In step S20, the ECU 100 calculates the pressure difference dP between a target pressure and the calculated fuel pressure.

Step S20 will now be described in detail with reference to FIG. 3. The ECU 100 has a target pressure Pt (control target value) set for the fuel pressure in the high-pressure distribution pipe 22. The target pressure Pt is in a range between a minimum fuel pressure Pmin and a maximum fuel pressure Pmax. The minimum fuel pressure Pmin is set so that the required fuel pressure is immediately obtained when switching from the port injection mode to the in-cylinder injection mode. The maximum fuel pressure Pmax is set so that fuel does not leak from the in-cylinder injectors 23. The ECU 100 has a tolerable range (Pt−dPt<Pt<Pt+dPt) set for the target pressure Pt. The tolerable range for the target pressure Pt is a range of the target pressure Pt plus/minus a tolerable value dPt, where dPt is greater than zero. The tolerable range for the target pressure Pt is set to be greater than the minimum fuel pressure Pmin but less than the maximum fuel pressure Pmax. More specifically, the tolerable range for the target pressure Pt has an upper limit (Pt+dPt) and a lower limit (Pt−dPt). A margin is provided between the upper limit and the maximum fuel pressure Pmax, and a margin is provided between the lower limit and the minimum fuel pressure Pmin.

In step S30, the ECU 100 determines whether the absolute value of the pressure difference dP is less than the tolerable value dPt. When the absolute value of the pressure difference dP is less than the tolerable value dPt as in the case of the pressure difference dP1 in FIG. 3 (YES in step S30), the fuel pressure in the high-pressure distribution pipe 22 is in the tolerable range of the target pressure Pt. In this case, the ECU 100 ends the control of FIG. 2 as this point of time.

When the absolute value of the pressure difference dP is greater than or equal to the tolerable value dPt (NO in step S30), the ECU 100 determines whether the pressure difference dP is positive or negative in step S40. When the pressure difference dP is negative as in the case of the pressure difference dP2 in FIG. 3 (NO in step S40), the fuel pressure in the high-pressure distribution pipe 22 is lower than the target pressure Pt by the tolerable value dPt or more. In this case, the ECU 100 controls actuation of the high-pressure pump 20 to raise the fuel pressure in the high-pressure distribution pipe 22 in step S50. Step S50 will be described in detail later.

Figure 3:
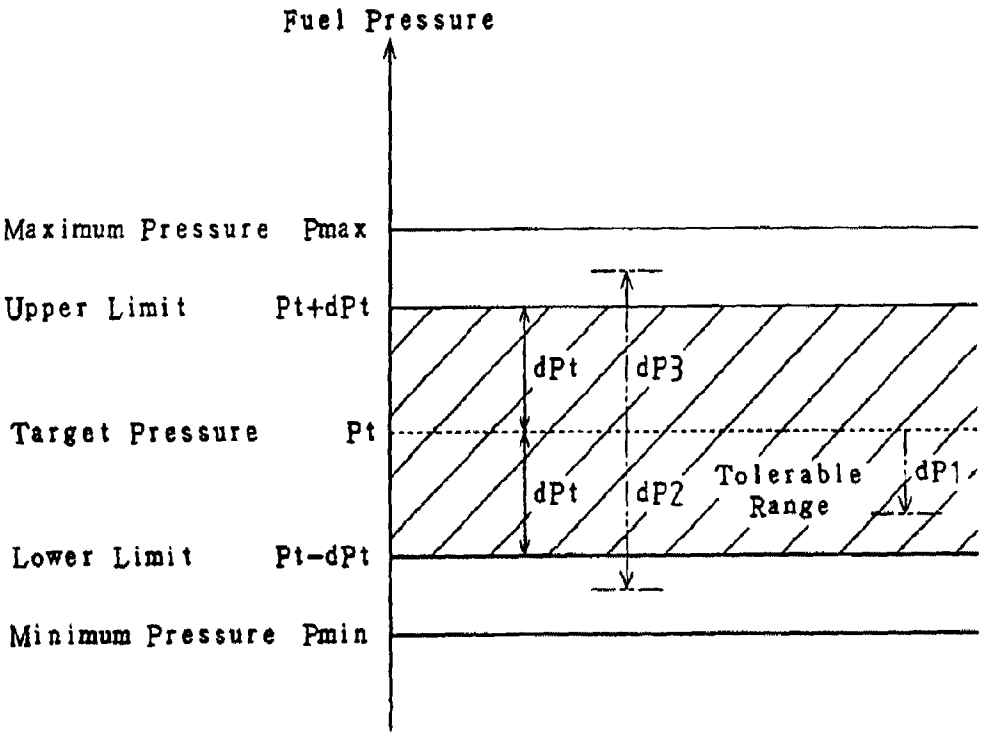
FIG. 3 is a graph showing a target value and an tolerable range for the fuel pressure in the high-pressure distribution pipe.

When the pressure difference dP is positive as in the case of the pressure difference dP3 in FIG. 3 (YES in step S40), the fuel pressure in the high-pressure distribution pipe 22 is higher than the target pressure Pt by the tolerable value dPt or more. In this case, the ECU 100 opens the relief valve 24 to lower the fuel pressure in the high-pressure distribution pipe 22 in step S60. In the preferred embodiment, the ECU 100 has a map associating the pressure difference dP and the open time of the relief valve 24. The ECU 100 determines the open time of the relief valve 24 based on the map. The ECU 100 opens the relief valve 24 for the determined time so that the fuel pressure in the high-pressure distribution pipe 22 is lowered to fall within the tolerable range for the target pressure Pt (Pt−dPt<Pt<Pt+dPt). Afterwards, the ECU 100 closes the relief valve 24.

Figure 4:
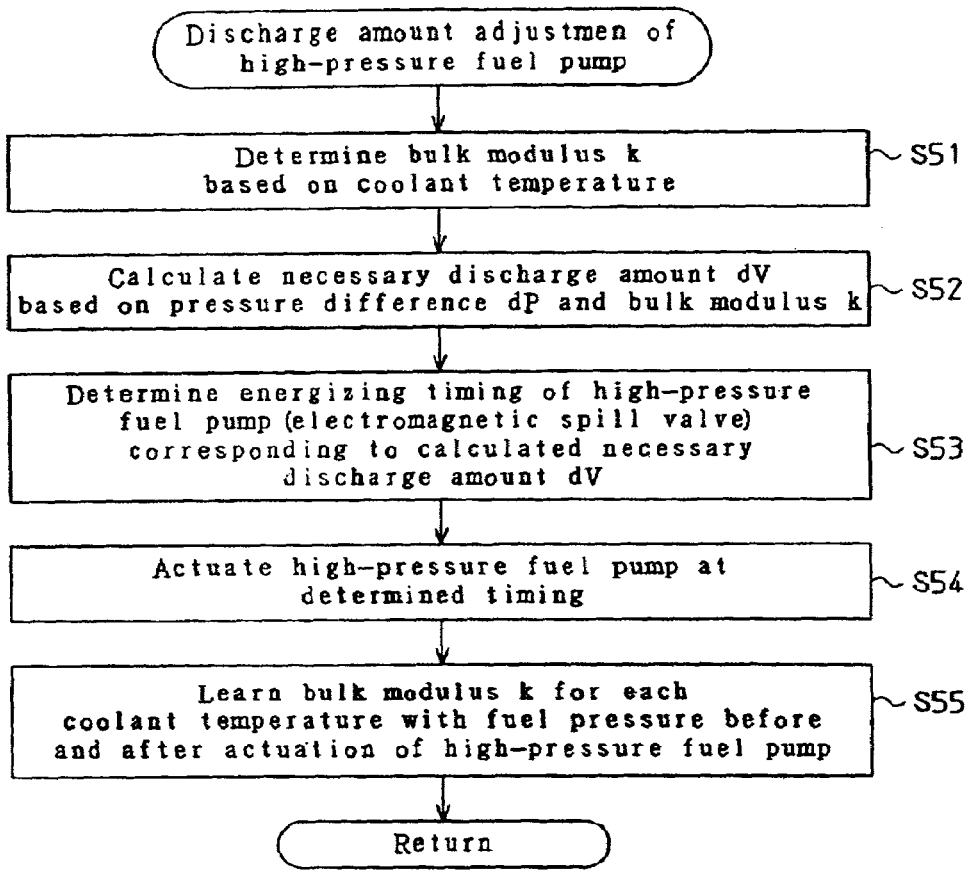
FIG. 4 is a flowchart showing adjustment of a discharge amount of a high-pressure pump.

The adjustment of the discharge amount of the high-pressure pump 20 in step S50 will now be described in detail with reference to the flowchart of FIG. 4.

When determining that the fuel pressure in the high-pressure distribution pipe 22 is lower than the target pressure Pt by the tolerable value dPt or more in step S40 (FIG. 2), the ECU 100 adjusts the discharge amount of the high-pressure pump 20 in step S50. To adjust the discharge amount of the high-pressure pump 20, the ECU 100 calculates the discharge amount of fuel necessary to raise the fuel pressure in the high-pressure distribution pipe 22 to the target pressure Pt, and actuates the high-pressure pump 20 in accordance with the calculated discharge amount.

More specifically, the ECU 100 determines a bulk modulus K of fuel based on the coolant temperature in step S51. For example, the ECU 100 determines the bulk modulus K using a map associating the bulk modulus K and the coolant temperature. In step S52, the ECU 100 calculates the discharge amount (necessary discharge amount) dV of fuel to be discharged from the high-pressure pump 20 based on the pressure difference dP and the bulk modulus K. In the preferred embodiment, the ECU 100 determines or calculates the necessary discharge amount dV from equation 1.

$$dP=K\times dV/(V+dV) \quad (1)$$

In equation 1, V represents the volumetric capacity (the inner volume) of the high-pressure distribution pipe.

In step S53, the ECU 100 determines the energizing timing of the electromagnetic spill valve 20*d* in the high-pressure pump 20 based on the discharge amount dV.

The determination of the energizing timing will now be described. The ECU 100 determines a control duty ratio X (duty value) of the high-pressure pump 20. In the preferred embodiment, the control duty ratio X is a ratio of the open time of the electromagnetic spill valve 20*d* with respect to the compression time (the compression stroke) of the plunger 20*b* of the high-pressure pump 20 (total time in which fuel is pressurized). The ECU 100 calculates the control duty ratio X from equation 2.

$$X=(dV/dV\max)\times 100 \quad (2)$$

In equation 2, dVmax represents the maximum discharge amount of the high-pressure pump.

When the determined or calculated necessary discharge amount dV is greater than the maximum discharge amount dVmax of the high-pressure pump 20, the necessary discharge amount dV is corrected to be the same as the maximum discharge amount dVmax. The control duty ratio X is 1.0 in this case.

The ECU 100 converts the determined control duty ratio X into a cam angle of the cam 32 and determines the cam angle resulting from the conversion as the energizing timing of the high-pressure pump 20 (electromagnetic spill valve 20*d*).

When the control duty ratio is converted into the cam angle, the cam angle resulting from the conversion may be corrected according to the engine speed. This correction enables the responsiveness of the high-pressure pump 20 with respect to discharge amount adjustment to be unaffected by the engine speed.

In step S54, the ECU 100 actuates the high-pressure pump 20 at the determined energizing timing. As a result, the high-pressure pump 20 feeds the amount of high-pressure fuel necessary to maintain the fuel pressure in the high-pressure distribution pipe 22 at the target pressure Pt in the port injection mode.

In step S55, the ECU 100 learns, or corrects and stores, the bulk modulus K of fuel using the fuel pressure before and after actuation of the high-pressure pump 20. More specifically, the ECU 100 obtains the fuel pressure in the high-pressure distribution pipe 22 from the detection signal provided from the pressure sensor 26. The ECU 100 calculates the difference dP' between this fuel pressure and the fuel pressure in the high-pressure distribution pipe 22 before the high-pressure pump 20 was actuated. The ECU 100 learns the bulk modulus K of fuel based on the pressure difference dP' and the amount of fuel actually discharged from the high-pressure pump 20, which is the necessary discharge amount dV.

More specifically, the ECU 100 learns the bulk modulus K using equation 3.

$$dP'=K\times dV/(V+dV) \quad (3)$$

The bulk modulus K changes according to the temperature of the fuel. Thus, the ECU 100 uses the above map associating the bulk modulus K of fuel and the coolant temperature to associate the bulk modulus K of fuel obtained from equation 3 with a physical value having a correlation with the fuel temperature. In the preferred embodiment, the ECU 100 learns the bulk modulus K for each coolant temperature. The ECU 100 may learn the bulk modulus K for predetermined ranges (control field) of the coolant temperature. By using the bulk modulus K that is learned in this way, the necessary discharge amount dV appropriate for the driving state of the internal combustion engine is calculated with high accuracy.

The calculation using equation 1 for calculating the fuel discharge amount (necessary discharge amount) dV necessary to maintain the fuel pressure at the target pressure Pt in the high-pressure distribution pipe 22 will now be described.

Assuming that the pressure applied to an object is raised by a predetermined pressure, the volume change amount per unit volume of the object is proportional to the bulk modulus (constant) determined in accordance with the type (material) of the object.

Assuming that the high-pressure pump 20 supplies the necessary discharge amount dV of high-pressure fuel to the high-pressure distribution pipe 22 and raises the fuel pressure in the high-pressure distribution pipe 22 to the target pressure Pt, the volume of fuel in the high-pressure distribution pipe 22 before the pressurization is equal to a volumetric capacity V of the high-pressure distribution pipe 22. The volume of fuel in the high-pressure distribution pipe 22 after the pressurization is equal to a total volume V+dV, which is the sum of the fuel volume before the pressurization (volume V) and the necessary discharge amount dV. The total volume V+dV of fuel is compressed and accommodated in the volumetric capacity V of the high-pressure distribution pipe 22 so that the pressure in the high-pressure distribution pipe 22 after the pressurization becomes the target pressure Pt. Thus, the volume change amount per unit volume of fuel is expressed as dV/(V+dV). The necessary discharge amount dV may be calculated from the proportional relationship dP=K×dV/(V+dV) between the above pressure difference dP and the volume change amount per unit volume of fuel.

The fuel supply apparatus of the preferred embodiment has the advantages described below.

(1) When the fuel pressure in the high-pressure distribution pipe 22 is lower than the target pressure Pt by the tolerable value dPt or more during the port injection mode, the ECU 100 calculates the fuel discharge amount (necessary discharge amount) dV of the high-pressure pump 20 that is necessary to raise the fuel pressure in the high-pressure distribution pipe 22 to the target pressure Pt. The ECU 100 actuates the high-pressure pump 20 with the calculated necessary discharge amount dV. This structure optimally stabilizes the fuel pressure in the high-pressure distribution pipe 22 during the port injection mode.

(2) The necessary discharge amount dV is calculated using the equation of dP=K×dV/(V+dV). Thus, the calculation of the necessary discharge amount dV is easy and accurate.

(3) The ECU 100 obtains the bulk modulus K of fuel from the actual fuel amount (necessary discharge amount) dV discharged from the high-pressure pump 20 and from the pressure difference dP' of the fuel pressure, which is the pressure as actually raised in the high-pressure distribution pipe 22 when supplied with the fuel amount dV. The ECU 100 then learns the bulk modulus K for each coolant temperature. The ECU 100 reflects the learned bulk modulus K when calculating the necessary discharge amount dV. Thus, the calculated necessary discharge amount dV is accurate. This accurately maintains the fuel pressure in the high-pressure distribution pipe 22 at the target pressure Pt.

The bulk modulus K of fuel is learned for each coolant temperature. Thus, even when the mode is switched to the port injection mode from the in-cylinder injection mode after the fuel temperature changes, the necessary discharge amount dV is accurately calculated.

(4) The ECU 100 determines the control duty ratio X of the high-pressure pump 20 corresponding to the necessary discharge amount dV and controls actuation of the high-pressure pump 20 based on the determined control duty ratio X. Thus, the amount of fuel discharged to the high-pressure distribution pipe 22 by the high-pressure pump 20 is easily and appropriately adjusted.

(5) When the fuel pressure in the high-pressure distribution pipe 22 is higher than the target pressure Pt plus the tolerable value dPt or more, the relief valve 24 is opened. This prevents the fuel pressure in the high-pressure distribution pipe 22 from being excessively raised.

(6) The target pressure Pt is set so that the required fuel pressure is immediately obtained when the port injection mode is switched to the in-cylinder injection mode. Thus, the fuel supply apparatus of the preferred embodiment satisfies the fuel pressure requirements of the internal combustion engine.

The target pressure Pt is set so that fuel does not leak from the in-cylinder injectors 23. This prevents the fuel pressure in the high-pressure distribution pipe 22 from being raised excessively and prevents an excessively high hydraulic pressure from being applied to the in-cylinder injectors 23.

It should be apparent to those skilled in the art that the present invention may be embodied in many other specific forms without departing from the spirit or scope of the invention. Particularly, it should be understood that the present invention may be embodied in the following forms.

The tolerable value dPt may take different values at high-pressure and low-pressure sides of the target pressure Pt.

The target pressure Pt is set as a control target value of the fuel pressure in the high-pressure distribution pipe 22 during the port injection mode and may take any value.

The necessary discharge amount may be determined by a method other than the method using equation 1. The volume change amount (volume reduction amount) per unit volume of high-pressure fuel in the high-pressure distribution pipe 22 that is caused by raising the fuel pressure in the high-pressure distribution pipe 22 has a correlation with the fuel amount (necessary discharge amount) discharged from the high-pressure pump 20 to the high-pressure distribution pipe 22. Taking this into consideration, the necessary discharge amount may be calculated using other methods. For example, the volume change amount (volume reduction amount) per unit volume of high-pressure fuel in the high-pressure distribution pipe 22 when the fuel pressure in the high-pressure distribution pipe 22 is raised to the target pressure Pt may be calculated first. Then, a total volume change amount (total volume reduction amount) of the high-pressure fuel in the high-pressure distribution pipe 22 may be calculated from the calculated volume change amount (volume reduction amount) per unit volume. When the fuel pressure is equal to the target pressure Pt, a fuel discharge amount of the high-pressure pump 20 necessary to compensate for the calculated total volume change amount (total volume reduction amount) in the high-pressure distribution pipe 22 may be calculated.

The internal combustion engine may have, instead of the air-intake passage injectors 19, an injector (e.g., a cold-start injector arranged in a surge tank) located in the air intake passage upstream from where the air intake passage branches to the intake port of each cylinder. The fuel supply apparatus of the present invention is applicable to any internal combustion engine having an in-cylinder injector and an air-intake passage injector. Accordingly, the fuel supply apparatus of the present invention is applicable to an internal combustion engine having a single cylinder.

The present examples and embodiments are to be considered as illustrative and not restrictive, and the invention is not to be limited to the details given herein, but may be modified within the scope and equivalence of the appended claims.

What is claimed is:

1. A fuel supply apparatus for an internal combustion engine, wherein the internal combustion engine includes a combustion chamber, an air intake passage connected to the combustion chamber, an in-cylinder injector for directly injecting fuel into the combustion chamber, an air-intake passage injector for injecting fuel into the air intake passage, a low-pressure pump for pumping fuel from a fuel tank and discharging low-pressure fuel, a low-pressure pipe for supplying the low-pressure fuel to the air-intake passage injector, a high-pressure pump for pressurizing the low-pressure fuel and discharging high-pressure fuel, and a high-pressure pipe for supplying the high-pressure fuel to the in-cylinder injector, the fuel supply apparatus comprising:

a controller for controlling the high-pressure pump, wherein if the pressure of the fuel in the high-pressure pipe is lower than a target pressure by a predetermined value when the fuel is being injected only from the air-intake passage injector, the controller determines a discharge amount for the high-pressure pump that is necessary to raise the pressure of fuel in the high-pressure pipe to the target pressure, and the controller controls the high-pressure pump in accordance with the determined necessary discharge amount.

2. The fuel supply apparatus according to claim 1, wherein the controller determines the necessary discharge amount based on a bulk modulus of the fuel and a difference between the target pressure and the pressure of fuel in the high-pressure pipe.

3. The fuel supply apparatus according to claim 2, wherein the controller determines the necessary discharge amount using the equation of $dP=K\times dV/(V+dV)$, where dV represents the necessary discharge amount, dP represents the difference between the target pressure and the pressure of the high-pressure fuel, K represents the bulk modulus of the high-pressure fuel, and V represents the volumetric capacity of the high-pressure pipe.

4. The fuel supply apparatus according to claim 2, wherein the controller corrects the bulk modulus based on a change in the pressure of the fuel in the high-pressure pipe before and after the high-pressure pump discharges the fuel.

5. The fuel supply apparatus according to claim 4, wherein the controller stores the bulk modulus for each of control fields defined by a physical value that changes according to the temperature of the fuel.

6. The fuel supply apparatus according to claim 1, wherein the controller determines a duty value for the high-pressure pump according to the calculated necessary discharge amount and controls actuation of the high-pressure pump based on the duty value.

7. The fuel supply apparatus according to claim 1, wherein the internal combustion engine further includes a relief valve that releases fuel from the high-pressure pipe, the controller opening the relief valve when the pressure of the fuel in the high-pressure pipe is higher than the target pressure by the predetermined value or more.

8. A fuel supply apparatus for an internal combustion engine, wherein the internal combustion engine includes a combustion chamber, an air intake passage connected to the combustion chamber, an in-cylinder injector for directly injecting fuel into the combustion chamber, an air-intake passage injector for injecting fuel into the air intake passage, a low-pressure pump for pumping fuel from a fuel tank and discharging low-pressure fuel, a low-pressure pipe for supplying the low-pressure fuel to the air-intake passage injector, a high-pressure pump for pressurizing the low-pressure fuel and discharging high-pressure fuel, and a high-pressure pipe for supplying the high-pressure fuel to the in-cylinder injector, the fuel supply apparatus comprising:

a pressure sensor for detecting the pressure of the fuel in the high-pressure pipe and generating a detection signal according to the pressure; and a controller for controlling the high-pressure pump in accordance with the detection signal, wherein if the pressure of the fuel in the high-pressure pipe is lower than a tolerable range when the fuel is being injected only from the air-intake passage injector, the controller determines a discharge amount for the high-pressure pump that is necessary for the high-pressure pump to achieve the tolerable range, and the controller generates a drive signal for driving the high-pressure pump in accordance with the determined necessary discharge amount.

9. The fuel supply apparatus according to claim 8, wherein the controller determines the necessary discharge amount using the equation of $dP=K\times dV/(V+dV)$, where dV represents the necessary discharge amount, dP represents the difference between a target pressure within the tolerable range and the pressure of the high-pressure fuel, K represents the bulk modulus of the high-pressure fuel, and V represents the volumetric capacity of the high-pressure pipe.

10. The fuel supply apparatus according to claim 9, wherein the controller corrects the bulk modulus based on a change in the pressure of the fuel in the high-pressure pipe before and after the high-pressure pump discharges the fuel.

11. The fuel supply apparatus according to claim 10, wherein the controller stores the bulk modulus for each of control fields defined by a physical value that changes according to the temperature of the fuel.

12. The fuel supply apparatus according to claim 8, wherein the internal combustion engine further includes a relief valve, arranged between the high-pressure pipe and the fuel tank, for returning the fuel in the high-pressure pipe to the fuel tank, and the controller drives the relief valve and returns at least some of the fuel in the high-pressure pipe to the fuel tank when the pressure of the fuel in the high-pressure pipe is higher than the tolerable range.

13. The fuel supply apparatus according to claim 8, wherein the drive signal has a duty ratio that is in accordance with the calculated necessary discharge amount.

14. A fuel supply apparatus for an internal combustion engine, wherein the internal combustion engine includes a combustion chamber, an air intake passage connected to the combustion chamber, an in-cylinder injector for directly injecting fuel into the combustion chamber, an air-intake passage injector for injecting fuel into the air intake passage, a low-pressure pump for pumping fuel from a fuel tank and discharging low-pressure fuel, a low-pressure pipe for supplying the low-pressure fuel to the air-intake passage injector, a high-pressure pump for pressurizing the low-pressure fuel and discharging high-pressure fuel, and a high-pressure pipe for supplying the high-pressure fuel to the in-cylinder injector, the fuel supply apparatus comprising:

a pressure sensor for detecting the pressure of the fuel in the high-pressure pipe and generating a detection signal according to the pressure; and a controller for controlling the high-pressure pump in accordance with the detection signal, wherein the controller is programmed to determine a discharge amount for the high-pressure pump that is necessary for the high-pressure pump to achieve the tolerable range if the pressure of the fuel in the high-pressure pipe is lower than a tolerable range during a period in which the in-cylinder injector stops injecting fuel, and to generate a drive signal for driving the high-pressure pump in accordance with the determined necessary discharge amount.

15. The fuel supply apparatus according to claim 14, wherein the controller is programmed to determine the necessary discharge amount using the equation of $dP=K\times dV/(V+dV)$, where dV represents the necessary discharge amount, dP represents the difference between a target pressure within the tolerable range and the pressure of the high-pressure fuel, K represents the bulk modulus of the high-pressure fuel, and V represents the volumetric capacity of the high-pressure pipe.

16. The fuel supply apparatus according to claim 15, wherein the controller is programmed to correct the bulk modulus based on a change in the pressure of the fuel in the high-pressure pipe before and after the high-pressure pump discharges the fuel.

17. The fuel supply apparatus according to claim 16, wherein the controller is programmed to store the bulk modulus for each of control fields defined by a physical value that changes according to the temperature of the fuel.

18. The fuel supply apparatus according to claim 14, wherein the internal combustion engine further includes a relief valve, arranged between the high-pressure pipe and the fuel tank, for returning the fuel in the high-pressure pipe to the fuel tank, and the controller is programmed to drive the relief valve and returns at least some of the fuel in the high-pressure pipe to the fuel tank when the pressure of the fuel in the high-pressure pipe is higher than the tolerable range.

19. The fuel supply apparatus according to claim 14, wherein the drive signal has a duty ratio that is in accordance with the calculated necessary discharge amount.

* * * * *